United States Patent [19]

Cohen et al.

[11] 3,944,424

[45] Mar. 16, 1976

[54] PHOTOGRAPHIC OR IMAGE RECIEVING ELEMENTS CONTAINING POLYMERIC MORDANTS

[75] Inventors: Hyman L. Cohen; Frederick Koeng; Ignazio Ponticello, all of Rochester, N.Y.

[73] Assignee: Eastman Kodak Company, Rochester, N.Y.

[22] Filed: Feb. 21, 1975

[21] Appl. No.: 551,947

Related U.S. Application Data

[62] Division of Ser. No. 400,778, Sept. 26, 1973, Pat. No. 3,898,088.

[52] U.S. Cl. ..... 96/119 R; 96/57; 96/74; 96/77; 96/84 A; 96/87 R; 96/114; 260/80.3 N; 428/500; 428/508; 428/511

[51] Int. Cl.[2] ..... G03C 1/84; G03C 3/00

[58] Field of Search ..... 96/84 A, 114, 57, 77, 119, 96/74, 77, 87 R; 428/500, 508, 511

[56] References Cited

UNITED STATES PATENTS

| | | | |
|---|---|---|---|
| 3,625,694 | 12/1971 | Cohen et al. | 96/84 |
| 3,709,690 | 1/1973 | Cohen et al. | 96/84 |
| 3,721,556 | 3/1973 | Fix | 96/84 A |

*Primary Examiner*—Ronald H. Smith
*Attorney, Agent, or Firm*—A. H. Rosenstein

[57] ABSTRACT

A water-insoluble polymer comprising repeating units at least ⅓ of said repeating units having the formula:

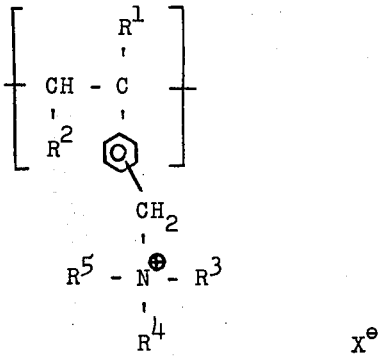

wherein $R^1$ and $R^2$ are hydrogen or alkyl and $R^3$, $R^4$ and $R^5$ are alkyl groups wherein the total number of carbon atoms in $R^3$, $R^4$ and $R^5$ is at least 12 and $X^-$ is an anion; is useful in dye mordant compositions in photographic elements. Preferred dye mordants comprise copolymers with styrene or methyl methacrylate.

10 Claims, No Drawings

PHOTOGRAPHIC OR IMAGE RECIEVING ELEMENTS CONTAINING POLYMERIC MORDANTS

This is a division of Ser. No. 400,788, filed Sept. 26, 1973, now U.S. Pat. No. 3,898,088.

The present invention relates to novel polymeric compounds which are good mordants for dyes used in photographic systems and to photographic systems using such polymers.

It is known in the photographic art to use various polymeric materials as mordants in integral negative receiver elements comprising a support and layer containing a silver halide emulsion to prevent the migration of dyes. Receiving elements containing mordants are described in U.S. Pat. No. 2,584,080.

Among the various polymers suggested as dye mordants are those formed by quaternizing a polymer containing tertiary nitrogen atoms with an alkylating or aralkylating agent such as described in U.S. Pat. No. 3,625,694 issued Dec. 7, 1971, to Cohen et al, and U.S. Pat. No. 3,709,690 issued Jan. 9, 1973, to Cohen et al.

The preparation of water soluble polymers containing trialkyl vinyl benzylammonium salts is described in C. D. Jones and S. J. Getz, J. Pol. Sci., 25, 201–215 (1957) and U.S. Pat. No. 3,178,396 to Lloyd. The search for mordant polymers having the ability to receive and hold dye strongly and to stabilize dye from changing hue at low pH has been quite extensive.

It is an object of this invention to provide new polymers.

It is another object of this invention to provide dye mordant polymers with improved properties.

It is another object of this invention to provide new photographic elements containing mordants with excellent dye holding properties.

It is still another object of this invention to provide photographic elements having mordanted images with increased densities.

It is a further object of this invention to provide a novel method of preparing photographic elements containing mordants with superior properties.

It is a still further object of this invention to provide a photographic element comprising a support, a silver halide layer and at least one layer comprising the composition of this invention.

Still another object of this invention is to provide an integral negative receiver photographic element comprising a support having a layer containing the polymeric mordant of this invention and at least one photosensitive silver halide emulsion layer which has contiguous thereto a dye image-providing material.

These and other objects are accomplished using a dye mordant composition comprising a water-insoluble polymer comprising units represented by the following formula:

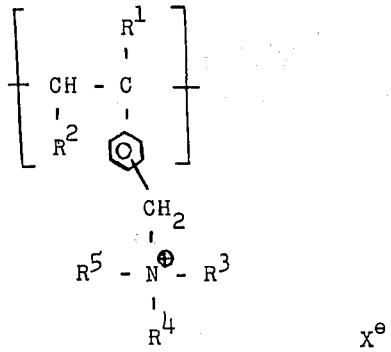

wherein $R^1$ and $R^2$ are hydrogen or alkyl and $R^2$ may be a group containing at least one aromatic nucleus, $R^3$, $R^4$ and $R^5$ are alkyl radicals comprising at least a total of 12 carbon atoms and $X^-$ is an anion. Compared to the prior art quaternary nitrogen containing mordants, wherein the nitrogen atom is substituted with aryl groups and where the polymers are water-soluble, the water-insoluble polymers of the present invention containing alkyl substituents on the nitrogen atom containing a total of at least 12 carbon atoms have been found to be distinctly superior mordants.

Preferred polymers according to this invention comprise units having the following formula:

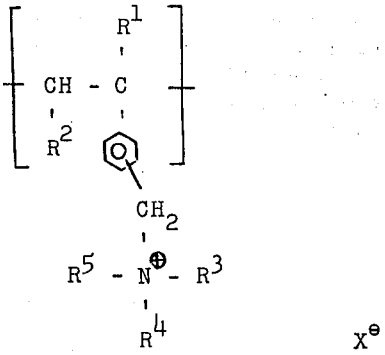

wherein $R^1$ and $R^2$ are hydrogen or lower alkyl containing from 1 to 6 carbon atoms such as methyl, ethyl, propyl, butyl, pentyl, hexyl and the like and $R^2$ can additionally be a group containing at least one aromatic nucleus such as aryl including substituted aryl, such as phenyl, tolyl, naphthyl, biphenyl, anthracenyl and the like; $R^3$, $R^4$ and $R^5$ are alkyl such as methyl, ethyl, propyl, isopropyl, butyl, pentyl, hexyl, octyl, decyl and the like wherein the total number of carbon atoms in $R^3$, $R^4$ and $R^5$ must be at least 12 and preferably from 12 to 30 and X is an anion; i.e., a monovalent negative salt forming ionic radical or atom such as a halido (e.g. bromine, chlorine) alkyl sulfate, alkane or arene sulfonate (for example, a p-toluenesulfonate), dialkyl phosphate or similar anionic moiety.

It is understood that the polymers can be homopolymers or copolymers with at least one other ethylenically unsaturated monomer so long as at least ⅓ of the repeating units of the copolymer constitute those having the formula described above and the resulting homopolymer or copolymer is water-insoluble and the cationic moiety of the polymer is substantially free of carboxyl (COOH) groups. The presence of carboxyl groups in the polymer interferes with effective dye mordanting.

Typical ethylenically unsaturated monomers which can be used to form ethenic copolymers (including two, three or more repeating units) according to this invention include ethylene, propylene, 1-butene, isobutene, 2-methylpentene, 2-methylbutene, 1,1,4,4-tetramethylbutadiene, styrene, alpha-methylstyrene; monoethylenically unsaturated esters of aliphatic acids such as vinyl acetate, isopropenyl acetate, allyl acetate, etc.; esters of ethylenically unsaturated mono- or dicarboxylic acids such as methyl acrylate, methyl methacrylate, ethyl acrylate, diethyl methylenemalonate, etc.; monoethylenically unsaturated compounds such as acrylonitrile, allyl cyanide, and dienes such as butadiene and isoprene. A preferred class of ethylenically unsaturated monomers which may be used to form the ethenic polymers of this invention includes the lower 1-alkenes having from 1 to 6 carbon atoms, styrene, and tetramethylbutadiene and methyl methacrylate.

It is noted that the polymer must be water-insoluble. Thus, although a homopolymer having 12 carbon atoms on the $R^3$, $R^4$ and $R^5$ substituents may be water-soluble and inoperable for the purposes of this invention, a similar polymer interpolymerized with styrene in the range of 20 to 80% by weight of the interpolymer may be water-insolube and can improve the mordanting properties desired. By "water-insoluble" it is meant that less than one gram of polymer will dissolve per 100 cc of water at room temperature (25°C).

The mordants of this invention are generally prepared by quaternizing a polymer comprising repeating units having the formula:

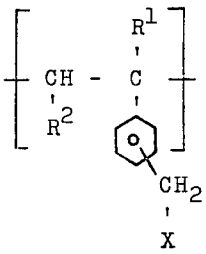

with a tertiary amine having the formula:

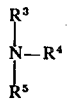

wherein $R^1$, $R^2$, $R^3$, $R^4$ and $R^5$ are as described above and X is a halogen atom. Polymers which may be reacted with the tertiary amine include poly(vinylbenzyl chloride) and copolymers of vinylbenzyl chloride with other ethylenically unsaturated monomers such as styrene and methyl methacrylate and the like. Typical suitable tertiary amines which may be used in this process include tributylamine, trihexylamine, tripentylamine, trioctylamine, diethyldodecylamine, dimethyltetradecylamine, dimethyloctadecylamine, dimethyldodecylamine, triisopentylamine and the like.

The vinyl polymer and tertiary amine may be reacted by heating in the presence of a solvent comprising alcohols (including aromatic alcohols) boiling above 100°C, particularly methoxyethanol, ethoxyethanol, and benzyl alcohol. The reaction may be carried out at any temperature but it is preferred to keep the reactants to from 70° to 110°C. The reaction may be carried out using substantially equimolar amounts of the polymer e.g. poly(vinylbenzyl halide) or the like and tertiary amine. An exchange of anions may be made, if desired, in order to produce polymeric, quaternary nitrogen group containing mordants to be employed in certain photographic supports such as dye-transfer systems. The exchange of anions merely involves reacting the polymer with a salt such as silver acetate, silver p-toluenesulfonate or the like containing the preferred anion.

The polymers resulting from the above reaction may additionally contain some recurring units of the structure:

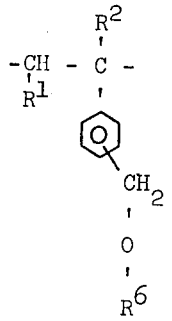

wherein $R^6$ is the residue of the alcohol solvent employed in the reaction mixture. $R^6$ may thus be an alkyl, alkaryl, aryl or alkoxyalkyl group such as methyl, ethyl, phenyl, benzyl, methoxyethyl, ethoxyethyl or the like.

In an alternative embodiment, the vinyl polymer may be incompletely quaternized by reacting less than a stoichiometric amount of tertiary amine with the polymer. The preferred mole percent quaternization is from 80 to 97.5 percent. The excess haloalkyl groups in the polymer backbone are then further reacted with a compound having more than one amine group such as polyamine. These polyamines may be represented by the formula $Z(NR^7R^8)_n$ wherein Z is an organic group, $R^7$ and $R^8$ can be hydrogen, alkyl or aryl and n is 2 or more. Examples of polyamines useful herein are gelatin, 1,4-butanediamine, imidizole, pyrazine, and the like. The amount of polyamine crosslinking agent added may vary from 0 to 20% by weight of the polymer. If the polyamine is also used as a binder material greater than 20% by weight can be added. The alkylating process may be carried out in a solvent, such as water, acetone, benzene, dimethylformamide, dimethyl sulfoxide, dimethylacetamide, alcohols such as methanol, ethanol, isopropanol, 2-ethoxyethanol, and the like. Temperatures from 20° to 80°C are generally used.

Some polymers which illustrate the mordants of this invention contain the following units wherein X is from 0 to 66⅔% and y is 100-X:

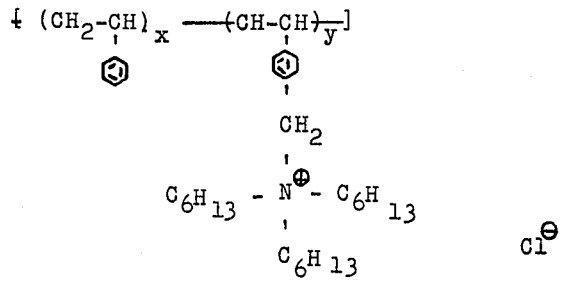

name = poly(styrene-co-N,N,N-trihexyl-N-vinylbenzylammonium chloride).

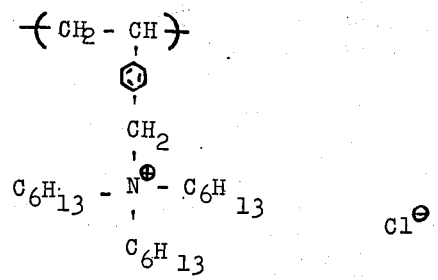

name = poly(N,N,N-trihexyl-N-vinylbenzylammonium chloride)

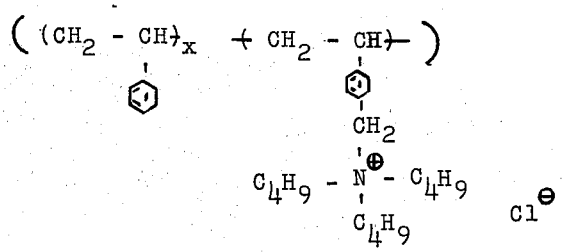

name = poly(styrene-co-N,N,N-tributyl-N-vinylbenzylammonium chloride)

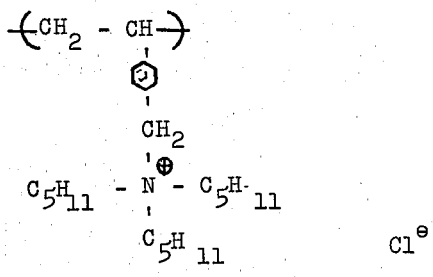

name = poly(N,N,N-tripentyl-N-vinylbenzylammonium chloride) and the like.

Any of the methods known in the art to homopolymerize the monomers or to copolymerize with other ethylenically unsaturated monomers, such as mass, solution, or bead polymerization can be used to prepare the polymers of this invention, and polymerization catalysts known to the art, such as ultraviolet light treatment, peroxides, azo compounds [i.e., 2,2'-azobis(2-methylpropionitrile)], and the like can be employed.

Mordanting amounts of the novel polymers of the invention can be employed, as such, from solvent solutions such as methanol, ethanol, or mixtures of methanol or ethanol with water and the like, or can be incorporated in organic binder materials. The resulting mixture can be used in the preparation of dye imbibition printing blanks, receiving layers for color transfer processes, such as those described in Land U.S. Pat. No. 3,362,819. Rogers U.S. Pat. No. 2,983,606, Whitmore U.S. Pat. No. 3,227,552 and U.S. Pat. No. 3,227,550, and in antihalation layers such as those described in Jones et al U.S. Pat. No. 3,282,699. Satisfactory binders used for this purpose include any of the hydrophobic binders generally employed in the photographic field, including, for example, poly(vinyl acetate), cellulose acetate butyrate, gelatin, poly(vinyl alcohol) and the like. Exemplary materials are disclosed in *Product Licensing Index*, Vol. 92, Dec. 1971, publication 9232, Page 108. In general, a mordanting amount of polymer can be employed in a dye mordanting or dye imagereceiving layer. A binder can be used along with the polymeric mordant in the layer. The amount of dye mordant to be used depends on the amount of dye to be mordanted, the mordanting polymers, the imaging chemistry involved, etc. and can be determined easily by one skilled in this art. It is preferred that between 20 and 80% by weight of polymer be used in the dye mordanting layers.

The dye image-receiving element can comprise a support having thereon a layer including the polymeric mordant composition of this invention. The element may also comprise other layers, such as a polymeric acid layer, and can also include a timing layer as taught in U.S. Pat. No. 3,362,819 or a light reflective interlayer comprising a light reflective white pigment, such as $TiO_2$, and a polymeric binder, in accordance with the teaching of Beavers and Bush U.S. Pat. No. 3,445,228.

The mordanting compositions of this invention are also especially useful in light-filtering layers, such as in anti-halation layers of the type disclosed in Jones and Milton U.S. Pat. No. 3,282,699. Here the light-filtering layer preferably can comprise a binder and the mordanting compositions of this invention. The layer is adapted to contain a dye held or fixed by the mordanting composition.

In addition, the novel mordants of this invention can also be employed in integral negative-receiver photographic elements such as those described in U.S. application Ser. No. 27,990 of Cole, filed Apr. 13, 1970, now abandoned, U.S. application Ser. No. 27,991 of Barr et al, filed Apr. 13, 1970 now abandoned and U.S. Pat. No. 3,415,644 issued Dec. 10, 1968. In general, these integral photographic elements comprise a support having thereon a layer containing one or more of the novel mordants described herein and at least one photosensitive silver halide emulsion layer, the silver halide of which has contiguous thereto a dye image-providing material.

The mordants can also be used for fixing the dyes, and particularly acid dyes, used in the preparation of photographic filter, antihalation and gelatino vs silver halide emulsion layers. Such layers can be coated on conventional photographic supports, such as flexible sheet supports (e.g., cellulose acetate, polyester films, polyvinyl resins, etc.) or paper, glass, etc.

More than one of the mordanting polymers of this invention can be used together, in a single layer or in two or more layers. The mordanting polymers of this invention can also be used in admixture with other mordants in the same layer or in separate layers of the same element.

Whether the polymers are employed in a single layer or in two layers, it is preferred that the total coverage of the mordanting layer or layers be from 5 to 55 mg/dm$^2$ in order to satisfactorily operate as a mordant.

Emulsions or compositions containing the polymers can be chemically sensitized with compounds of the sulfur group and/or noble metal salts (such as gold salts), reduction sensitized with reducing agents, or any combination of these. Furthermore, emulsion layers and other layers present in photographic elements made according to this invention can be hardened with any suitable hardener such as aldehyde hardeners, aziridine hardeners, hardeners which are derivatives of dioxane, oxypolysaccharides such as oxystarch, oxy plant gums, and the like. The emulsion can also contain additional additives, particularly those known to be beneficial in photographic emulsions, including for example, stabilizers or antifoggants, particularly the water soluble inorganic acid salts of cadmium, cobalt, manganese and zinc as disclosed in U.S. Pat. No. 2,829,404, the substituted triazaindolizines as disclosed in U.S. Pat. Nos. 2,444,605 and 2,444,607, speed increasing materials, plasticizers and the like. Examples of these additives are found in *Product Licensing Index*, Vol. 92, Dec. 1971, publication 9232, Pages 107 to 110.

Mordanted blanks treated in accordance with this invention are useful for receiving acid dyes from hydrophilic colloid relief images according to prior art techniques. Typical acid dyestuffs which can be transferred to the treated blanks of the invention are Anthracene Yellow GR (400% pure Schultz No. 177), Fast Red S Conc. (Colour Index 176), Pontacyl Green SN Ex. (Colour Index 737), Acid blue black (Colour Index 246), Acid Magenta O (Colour Index 692), Naphthol Green B Conc. (Colour Index 5), Billiant Paper Yellow Ex. Conc. 125% (Colour Index 364), Tartrazine (Colour Index 640), Metanil Yellow Conc. (Colour Index 138), Pontacyl Carmine 6B Ex. Conc. (Colour Index 57), Pontacyl Scarlet R Conc. (Colour Index 487) and Pontacyl Rubine R Ex. Conc. (Colour Index 179).

This invention is further illustrated by the following examples.

EXAMPLE 1

A reactor was charged with 15 grams of poly(styrene-covinylbenzyl chloride) in a 1:1 mole ratio of styrene to vinylbenzyl chloride wherein 60% of the vinylbenzyl chloride is the meta isomer and 40% is the para isomer in 150 ml benzyl alcohol and 16 g of tris (n-pentyl)amine. The mixture was heated on a steam pot for about 16 hours, cooled, and poured into diethyl ether to precipitate the product. The solid was collected, washed with ether, and vacuum dried to produce 18.5 g of poly (styrene-co-N,N,N-tripentyl-N-vinylbenzylammonium chloride).

EXAMPLE 2

A mixture of 40 g of methyl methacrylate, 61 g of vinylbenzyl chloride, 500 mg of potassium persulfate, 200 mg of sodium bisulfite, 4 ml of the sodium salt of an alkyl-aryl poly(ether sulfate) commercially available under the trademark Triton 770 from Rohm and Haas Company and 200 ml of water was heated at 60°C for 3 hours in a nitrogen atmosphere. The mixture was then held at −20°C overnight and allowed to come to room temperature. The solid was filtered and washed with water and methanol. The white powder was dried under vacuum at room temperature. The resulting polymer had an inherent viscosity in acetone of 0.87.

A reactor was charged with a mixture of 12.5 g of poly (methyl methacrylate-co-vinylbenzyl chloride) prepared above, 21 g of trihexylamine and 200 ml of ethoxyethanol and heated at 80° to 90°C to 3 days in a nitrogen atmosphere. The polymer was precipitated from the resulting viscous solution in hexane, filtered, washed and dried in a vacuum oven at 40°C. The polymer was dissolved in methanol, and precipitated in a mixture of hexane-ether (1:1 by volume). The resulting copoly(methyl methacrylate-co-N,N,N-tri-n-hexyl-N-vinylbenzylammonium chloride) had an inherent viscosity in methanol of 8.56 at 25°C and at a concentration of 0.25 g/dl.

EXAMPLE 3

The process of Example 2 was carried out with the substitution of tri-n-butylamine for tri-n-hexylamine. Poly(methyl methacrylate-co-N,N,N-tri-n-butyl-N-vinylbenzylammonium chloride) resulted.

EXAMPLE 4

The process of Example 2 was repeated with the substitution of triisopentylamine for tri-n-hexylamine. Poly(methyl methacrylate-co-N,N,N-triisopentylamine-N-vinylbenzylammonium chloride) resulted.

EXAMPLES 5 TO 10

The following compounds shown in Table I were prepared as in Example 1 with the substitution of various trialkylamines. The general formula of the resulting polymers was:

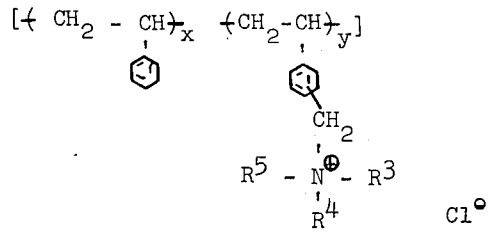

wherein $x = 0$ to 66⅔% and y equals $100 - x$.

TABLE I

| EXAMPLE | $R^3$ | $R^4$ | $R^5$ | Solvent Used In Preparation | Anal. (Calc'd/Found) C | H | N | Cl | Inherent Viscosity |
|---|---|---|---|---|---|---|---|---|---|
| 5 | $-C_4H_9$ | $-C_4H_9$ | $-C_4H_9$ | Benzyl | 78.8 | 10.0 | 3.2 | 8.0 | 1.6 |
| | | | | Alcohol | 78.5 | 10.0 | 3.2 | 7.8 | |
| 6 | $-C_5H_{11}$ | $-C_5H_{11}$ | $-C_5H_{11}$ | Benzyl | 79.4 | 10.3 | 2.9 | 7.4 | 0.82 |
| | | | | Alcohol | 77.9 | 9.7 | 2.2 | 6.1 | |
| 7 | $-C_6H_{13}$ | $-C_6H_{13}$ | $-C_6H_{13}$ | 2-Methoxy- | 79.9 | 10.7 | 2.7 | 6.7 | 0.81 |
| | | | | ethanol | 76.9 | 10.9 | 2.0 | 5.0 | |
| 8 | $-C_7H_{15}$ | $-C_7H_{15}$ | $-C_7H_{15}$ | Benzyl | 81.4 | 10.9 | 2.5 | 6.2 | 1.78 |
| | | | | Alcohol | 78.1 | 11.1 | 2.1 | 5.6 | |
| 9 | $-C_8H_{17}$ | $-C_8H_{17}$ | $-C_8H_{17}$ | Benzyl | 82.1 | 9.7 | 2.3 | 5.9 | 1.78 |
| | | | | Alcohol | 81.2 | 11.1 | 1.8 | 5.1 | |
| 10 | $-CH_3$ | $-CH_3$ | $-C_{12}H_{25}$ | N,N-Di- | 76.6 | 10.7 | 3.6 | 9.1 | 0.61 |
| | | | | methylform- | 78.0 | 10.5 | 2.9 | 7.3 | |
| | | | | amide and | | | | | |

TABLE I-continued

| EXAMPLE | $R^3$ | $R^4$ | $R^5$ | Solvent Used In Preparation | Anal. (Calc'd/Found) C | H | N | Cl | Inherent Viscosity |
|---|---|---|---|---|---|---|---|---|---|
| | | | | benzyl alcohol | | | | | |

The inherent viscosities were measured in benzene at 25°C at a concentration of 0.25 g/deciliter of solution.

EXAMPLES 11 TO 25

The polymers of the present invention were tested for mordanting properties in relationship to a dye mordant similar to those described herein, [poly(styrene-co-N-benzyl-N,N-dimethyl-N-(3-maleimidopropyl)ammonium chloride]. The mordanting property tested was K, a competitive constant.

The competition tests to determine K were run by forming a structure as shown below in which a yellow dye and a magenta dye were dissolved in fluid containing 40g per liter of hydroxy ethyl cellulose in one molar KOH at a pH of 14 and sandwiched between the conventional mordant structure and a test mordant as follows:

View

Test Mordant
$TiO_2$
Fluid and Dye
$TiO_2$
Standard Mordant

View

The reflection densitometry at timed intervals on both faces of the sandwich was used to monitor the appearance of dye in each mordant layer. Density readings were taken at 24 hours to determine to which mordant the dye diffused to a greater degree. The value K is determined by dividing the test mordant reflection density by the standard mordant reflection density. This provides a ratio of mordanting ability of the tested mordant versus the standard mordant.

The following Table 2 indicates the various competition values for homopolymers and copolymers of the following polymer structure:

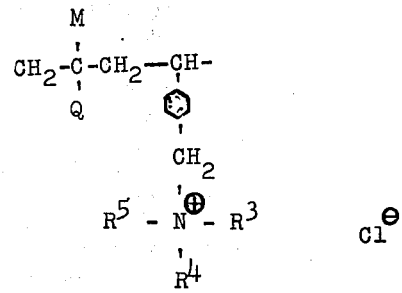

for both the magenta dye ($K_m$) and yellow dye ($K_y$).

TABLE II

| Example | M | Q | $R^3$ | $R^4$ | $R^5$ | K(y) | K(m) | Composition (Mole Percents) |
|---|---|---|---|---|---|---|---|---|
| Control A | H | 0 | $CH_3$ | $CH_3$ | 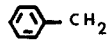 | 1.0 | 1.0 | 50% styrene |
| Control B | H | 0 | $CH_3$ | $CH_3$ | $CH_3$ | 2.9 | 3.1 | 50% styrene |
| Control C | H | 0 | $C_2H_5$ | $C_2H_5$ | $C_2H_5$ | 2.8 | 2.9 | 50% styrene |
| Control D | H | 0 | $C_3H_7$ | $C_3H_7$ | $C_3H_7$ | 3.1 | 3.5 | 50% styrene |
| Control E | H | 0 | $C_4H_9$ | $C_4H_9$ | $C_4H_9$ | 3.6 | 3.7 | 50% styrene |
| Example 11 | H | 0 | $C_5H_{11}$ | $C_5H_{11}$ | $C_5H_{11}$ | 6.4 | 15.4 | 50% styrene |
| Example 12 | H | 0 | $C_6H_{13}$ | $C_6H_{13}$ | $C_6H_{13}$ | 15.5 | 14.2 | 50% styrene |
| Example 13 | H | 0 | $C_8H_{17}$ | $C_8H_{17}$ | $C_8H_{17}$ | 14.0 | 11.3 | 50% styrene |
| Example 14 | H | 0 | $C_2H_5$ | $C_2H_5$ | $C_{12}H_{25}$ | 12.1 | 12.7 | 50% styrene |
| Example 15 | H | 0 | $CH_3$ | $CH_3$ | $C_{14}H_{29}$ | 11.3 | 11.9 | 50% styrene |
| Example 16 | H | 0 | $C_5H_{11}$ | $C_5H_{11}$ | $C_5H_{11}$ | 17.1 | 16.1 | 60% styrene |
| Example 17 | H | 0 | $C_5H_{11}$ | $C_5H_{11}$ | $C_5H_{11}$ | 15.6 | 15.8 | 33% styrene |
| Example 18 | H | 0 | $C_6H_{13}$ | $C_6H_{13}$ | $C_6H_{13}$ | 14.6 | 15.3 | 33% styrene |
| Example 19 | H | 0 | $CH_3$ | $CH_3$ | $C_{18}H_{37}$ | 5.2 | 4.8 | 50% styrene |
| Example 20 | H | 0 | $CH_3$ | $CH_3$ | $C_{12}H_{25}$ | 14.7 | 14.9 | 50% styrene |
| Example 21 | — | — | $C_6H_{13}$ | $C_6H_{13}$ | $C_6H_{13}$ | 15.6 | 14.3 | Homopolymer |
| Control F | — | — | $C_4H_9$ | $C_4H_9$ | $C_4H_9$ | 0.88 | 1.10 | Homopolymer |
| Example 22 | H | 0 | $C_4H_9$ | $C_4H_9$ | $C_4H_9$ | 8.6 | 11.9 | 67% styrene |
| Example 23 | $CH_3$ | $CO_2CH_3$ | $C_6H_{13}$ | $C_6H_{13}$ | $C_6H_{13}$ | 13.5 | 14.3 | 50% styrene |
| Example 24 | $CH_3$ | $CO_2CH_3$ | $C_4H_9$ | $C_4H_9$ | $C_4H_9$ | 8.5 | 9.7 | 50% styrene |
| Example 25 | $CH_3$ | $CO_2CH_3$ | $isoC_5H_{11}$ | $isoC_5H_{11}$ | $isoC_5H_{11}$ | 13.2 | 14.5 | 50% styrene |

It is noted that Examples 11 to 25 are all water-insoluble polymers and controls A to F are water-soluble. It is thus seen that surprisingly superior mordanting properties are obtained using water-insoluble polymers wherein $R^3$, $R^4$ and $R^5$ contain a total of at least 12 carbon atoms.

EXAMPLE 26

This is a comparative example.

The general method of reacting tertiary amines having lower alkyl substituents with polyvinyl benzyl chloride copolymers described in the prior art in U.S. Pat. No. 3,178,396 to Lloyd and D. Jones and S. J. Getz, J. Ply. Sci., 25, (1957) was used in an attempt to prepare the copolymer containing $R^3$, $R^4$ and $R^5$ having a total of at least 12 carbon atoms as follows.

A reactor was charged with a solution of 1 g of poly (styrene-co-vinylbenzyl chloride) in 10 ml of N,N-dimethyl formamide and 2 grams of tripentylamine. The mixture was stirred and heated in a steam bath for 30 minutes. The polymer gelled and was insoluble in acetone, methanol, benzene, N,N-dimethylformamide and dimethyl sulfoxide.

The reaction was repeated with the tripentyl amine replaced with tri-n-hexylamine and the solvent replaced with methanol, ethanol and finally isopropanol. The reaction did not go to completion using any of these solvents.

EXAMPLE 27

A reactor was charged with 50 grams of poly(styrene-co-vinylbenzyl chloride), 0.16 moles of tri-n-hexylamine and 900 ml of 2-methoxyethanol and the mixture was stirred for 24 hours at 95°C. The solution was cooled and 15 mls of concentrated HCl were added. The mixture was poured into water, with stirring, to precipitate the polymer and the polymer was washed with water and dried in vacuum to produce 80 g of polymer which was 80% quaternized.

The invention has been described in considerable detail with reference to preferred embodiments thereof, but it will be understood that variations and modifications can be effected within the spirit and scope of the invention as described hereinabove and as defined in the appended claims.

We claim:

1. A photographic element comprising a support and at least one layer which comprises a water-insoluble polymer comprisng repeating units represented by the following formula:

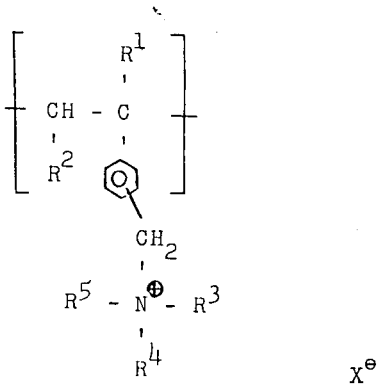

wherein $R^1$ and $R^2$ are hydrogen atoms or alkyl groups and $R^3$, $R^4$ and $R^5$ are alkyl groups wherein the total number of carbon atoms in $R^3$, $R^4$ and $R^5$ is at least 12 and $X^-$ is an anion.

2. The photographic element of claim 1 wherein the polymer is a copolymer with at least one other ethylenically unsaturated monomer and wherein at least 1/3 of the repeating units comprise the formula of claim 1.

3. A photographic element comprising a support and at least one layer which comprises a water-insoluble polymer comprising units represented by the following formula:

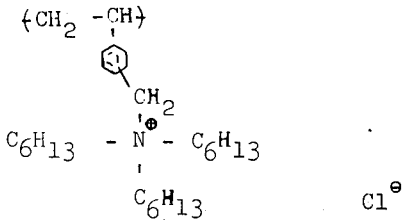

4. A photographic element comprising a support and at least one layer which comprises a water-insoluble copolymer having the formula

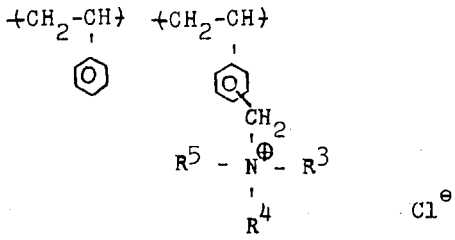

wherein $R^3$, $R^4$ and $R^5$ are alkyl groups wherein the total number of carbon atoms in $R^3$, $R^4$ and $R^5$ is at least 12.

5. A dye image receiving element comprising a support having thereon a dye mordant layer which comprises a water-insoluble polymer comprising units represented by the following formula:

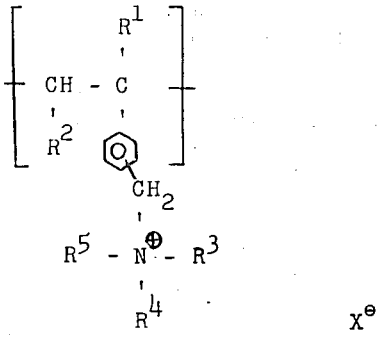

wherein $R^1$ and $R^2$ are hydrogen or alkyl and $R^3$, $R^4$ and $R^5$ are alkyl groups wherein the total number of carbon atoms in $R^3$, $R^4$ and $R^5$ is at least 12 and $X^-$ is an anion.

6. The dye image receiving element of claim 5 wherein the polymer is a copolymer with at least one other ethylenically unsaturated monomer wherein at least ⅓ of the repeating units comprise the formula of claim 5.

7. The dye image receiving element of claim 6 wherein an ethylenically unsaturated monomer is styrene.

8. The dye image receiving element of claim 6 wherein an ethylenically unsaturated monomer is methyl methacrylate.

9. The dye image receiving element of claim 5 wherein the water-insoluble polymer comprises units represented by the following formula:

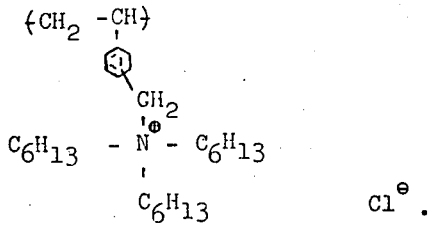

10. The dye image receiving element of claim 5 wherein the water-insoluble copolymer has the formula:

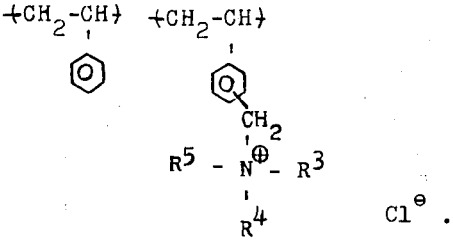

wherein $R^3$, $R^4$ and $R^5$ are alkyl groups wherein the total number of carbon atoms in $R^3$, $R^4$ and $R^5$ is at least 12.

* * * * *

Disclaimer 3,944,424.—*Hyman L. Cohen; Frederick Koeng* and *Ignazio Ponticello,* Rochester, N.Y. PHOTOGRAPHIC OR IMAGE RECEIVING ELEMENTS CONTAINING POLYMERIC MORDANTS. Patent dated Mar. 16, 1976. Disclaimer filed Mar. 18, 1981, by the assignee, *Eastman Kodak Co.*

Hereby enters this disclaimer to all claims of said patent.

[*Official Gazette May 26, 1981.*]